United States Patent [19]

Ikemoto

[11] Patent Number: 4,524,559

[45] Date of Patent: Jun. 25, 1985

[54] HAND WRAPPING APPARATUS

[76] Inventor: Shigeru Ikemoto, 36-banchi, Honmaeda-cho, Nakagawa-ku, Nagoya, Japan

[21] Appl. No.: 520,507

[22] Filed: Aug. 4, 1983

[30] Foreign Application Priority Data

Aug. 27, 1982 [JP] Japan ..... 57-130135[U]

[51] Int. Cl.[3] ..... B65B 11/02

[52] U.S. Cl. ..... 53/219; 53/390

[58] Field of Search ..... 53/219, 390

[56] References Cited

U.S. PATENT DOCUMENTS

| | | | |
|---|---|---|---|
| 2,635,672 | 4/1953 | Rumsey, Jr. | 53/219 |
| 3,546,836 | 12/1970 | Buob et al. | 53/390 |
| 3,595,456 | 7/1971 | Rosenthal | 53/390 |
| 3,800,499 | 4/1974 | Feldman | 53/219 |
| 4,223,511 | 9/1980 | Black | 53/390 |

*Primary Examiner*—Lowell A. Larson
*Assistant Examiner*—Linda McLaughlin
*Attorney, Agent, or Firm*—Steele, Gould & Fried

[57] ABSTRACT

A hand wrapping apparatus for manually wrapping products such as a food-laden tray by a web-like package film emanated from a film roll. The apparatus comprises a film roll, a film withdrawal slot to introduce the film into exterior therethrough in response to the unrolling action of the film roll, a film severing tool arranged in the neighborhood of the slot, a rocker bar having an upper end positioned to meet the slot across the severing tool and being usually urged by a spring toward the severing tool, and a heat sealer mounted on the end of rocker bar in order to weld the film around the product, and, at the same time, have the rocker bar pivot against the force of the spring to sweep the film past the severing tool to cut it when the product is placed thereupon.

5 Claims, 7 Drawing Figures

HAND WRAPPING APPARATUS

BACKGROUND OF THE INVENTION (1) Field of the Invention

This invention concerns a wrapping apparatus for manually wrapping product means in such web-like material as a plastic film emanated from a roll, and more particularly relates to an apparatus having an improved heat sealer construction which thermally seals the film folded around the product means.

(2) Description of the Prior Art

In a general hand wrapping apparatus, the apparatus comprises a film roll supported by a pair of rollers, a film withdrawal slot, a severing tool, and a flat-shape heat sealer.

At the time of wrapping the product means, the film on the roll is manually pulled out through the slot to be thrown around the product means, and severed by the severing tool as the proper length of the film is withdrawn. Then, the product means thus wrapped in the film is conveyed to the heat sealer to be placed thereupon, so that the overlapped portion of the film is thermally welded to seal the product.

The construction is such that the product means needs to be transferred from the position of the severing tool to that of the heat sealer at the stage of sealing the product, thus requiring a discontinuous, stepped procedure to resultantly make this a laborious task for an operator particularly in those instances where a number of the products are successively wrapped.

SUMMARY OF THE INVENTION

It is, therefore, a primary object of the present invention to provide a novel hand wrapping apparatus which will particularly obviate the above drawback over the prior art counterparts.

It is an object of the invention to provide a hand wrapping apparatus which permits a film severing action to sequentially follow a film welding action, thereby ensuring simple and smooth wrapping operation with minimum labor.

According to the present invention, there is provided a wrapping apparatus comprising a film roll supported by a pair of rollers each mounted on one side of a frame; a film withdrawal slot disposed at the other side of the frame to introduce the film on the roll to the exterior in response to the film unrolling action; a film severing means mounted on the frame in the neighborhood of the slot; a rocker means pivotably mounted on the frame to have one end positioned so as to meet the slot across the severing means, and being usually biased toward the severing means by a spring means; a heat sealer means mounted on one end of the rocker means to weld the film around the product means by placing it thereupon, and the rocker means pivoting against the force of the spring means to sweep the film past the severing means to sever it.

The construction is such that the rocker bar pivots toward the severing means in response to the action to place the product means on the heat sealer. Thus allows the film severing action to sequentially follow the film welding action so as to eventually ensure a simple and smooth wrapping operation.

The above and other objects, features and advantages of the present invention will become apparent from the following description and the appended claims, taken in conjunction with the accompanying drawings which show by way of example a preferred embodiment of the present invention and in which like component parts are designated by like reference numerals throughout the various figures.

DESCRIPTION OF THE PREFERRED EMBODIMENT

Figure 1:
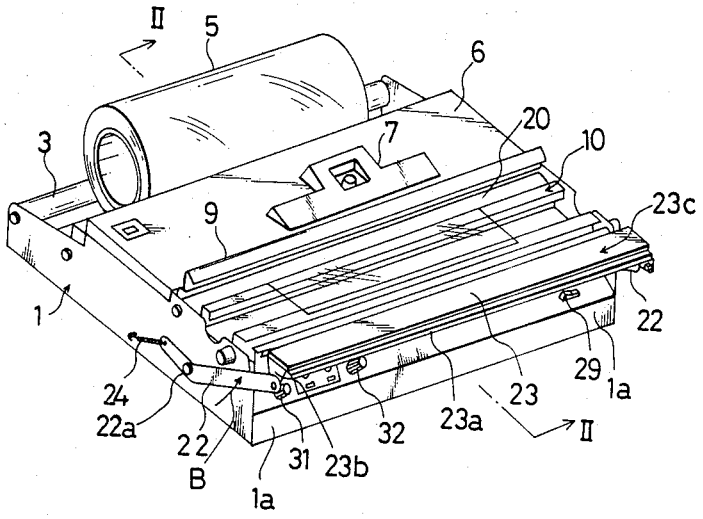
FIG. 1 is a perspective view of a hand wrapping apparatus.
Figure 2:
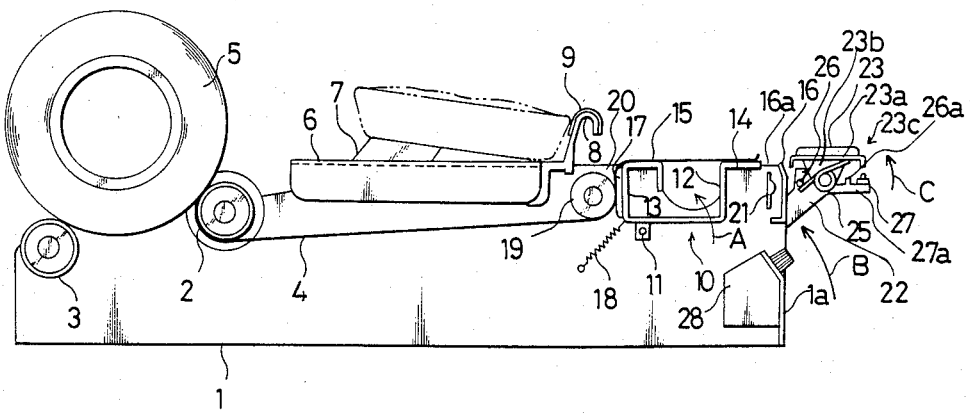
FIG. 2 is an enlarged longitudinal cross sectional view taken along the line II—II.

Referring to the drawings and first to FIGS. 1 and 2, there is shown a hand wrapping apparatus having a frame 1, one side of which has a film roll 5 supported by a pair of horizontally spaced rollers 2 and 3. In the upper middle surface of the frame 1 is provided a lid plate 6 on which a product rest 7 is slidably mounted to adjust its position. From the front end of the lid plate 6 is an inverse J-shaped projection 8 extends upwardly the bight portion of which is covered by a sheet of snubber metal 9 which has a tendency to retain the film 4 by its adherence as is better understood later. In the front neighborhood of the projection 8 is a trough-shaped cross extension 10 which is rockably mounted on the frame 1 by means of a pin 11. The pin 11 is in axial alignment with the extension 10, so the extension 10 rocks about the pin 11 in dual direction of arrow A and opposite to arrow A as depicted in FIG. 2, and is always biased by a tension spring 18 to rock in the direction of arrow A. The extension 10 has one side which serves as a front rise wall 12, and another side as a rear rise wall 13, each upper end of which has horizontally flat-shaped front and rear snubbers 14, 15. Attached to the outer side of the rear rise wall 13 is a film guide 17 which has a substance to allow the film 4 to smoothly slide thereon. In the vicinity of the film guide 17 is a film withdrawal roller 19 which is disposed to form a film withdrawal slot 20 therebetween.

Forwardly of the cross extension 10, there is crosswisely arranged a severing tool 21 such as, for example, a thermal cutter. The thermal cutter is positioned between the front snubber 14 and a protective cover 16 mounted on the extension 10, but positioning in front of the severing tool 21 with an upper elongated opening **16*a* defined therebetween. The severing tool 21 is adapted to usually position so as to look up the opening 16*a*, and to relatively move upwardly through the opening 16*a* to project above front snubber 14 when the extension 10** rocks in the direction opposite to arrow A.

On the right and left side walls of the frame 1 is a rocker arm 22, which arms are pivotably mounted at a pivot **22*a* in slantwise-oriented condition. The slanted upper end of the arm 22 positions to face the extension 10 across the severing tool 21, while the other end of the arm 22 has a tension coil spring 24 secured to the side wall of the frame, so the arm 22 is always biased in the direction of arrow B. Across the rocker arms 22, 22 is disposed a mounting sheet 23*a*, each end of which has a triangular plate 23*b* integrally depending therefrom. Each triangular plate 23*b* is pivoted to the slanted upper end of the rocker arm 22 to allow pivotal motion for the sheet 23***a*. To the upper surface of the sheet 23*a* is secured a heat panel 23 which has a built-in electrical heater (not shown) so as to form a heat sealer construction 23*c* in cooperation with the sheet 23*a*. Between the sheet 23*a* and a stop pin 26*a* mounted on the arm 22 is a torsion coil spring 25 secured to always bias the heat sealer 23*c* in the direction of arrow C, but usually holding the heat sealer 23*c* in coplanner relationship with a horizontal plane by engaging the plate 23*b* against the stop lug 26 formed in the arm 22 extending upward as seen in FIG. 2. A detector switch 27 such as, for example, a limit switch is mounted on a lateral branch 27*a* which projects from the slanted upper portion of the arm 22, so that the switch 27 is closed to energize the heater of the heat panel 23 when the heat sealer 23*c* pivots in the direction opposite to arrow C. A stop pin 26*a* mounted on the branch 27*a* is in the proximity of the switch 27, and limits unnecessary pivotal movement of the heat sealer 23*c* to protect the switch 27 from being damaged. In the front portion of the frame 1 is installed a control panel 28 which encloses an impulse current supply circuit (not shown) to provide an impulse current to the heater of the heat panel 23. Note that an electric power supply button 29 and heat adjuster knobs 32 and 31 are mounted on the front panel 1*a* of the frame 1, the knobs 32 and 31 being in turn employed for controlling the severing tool 21 and the heat sealer 23*c*.

OPERATION

The film 4 on the roll 5 is introduced above the extension 10 through the film withdrawal slot 20 via the rollers 2 and 19 to adhesively retain the leading portion at both the front and rear snubbers 14, 15 as seen in FIG. 2.

Figure 3:
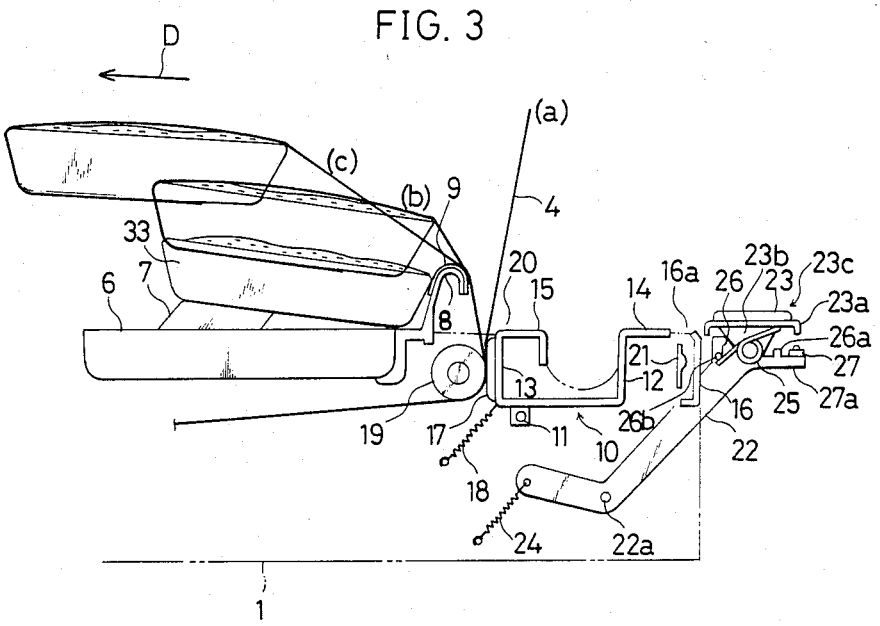
FIGS. 3 through 6 are enlarged longitudinal cross sectional views of the main components illustrated for the purpose of explaining a wrapping procedure.

(i) The leading end of the film 4 is manually pulled out, for example, slantwise forward accompanied with sliding movement against the guide 17 as better understood by comparing FIG. 2 and (a) of FIG. 3.

(ii) Then, the film 4 is moved rearward from the position at (a) of FIG. 3 to partially wrap around a goods-laden tray 33 acting as product means which have been previously deposited on the package rest 7 as seen at (b) of FIG. 3.

(iii) The partially wrapped tray 33 is moved in the direction of arrow D the film 4 contacting with the snubber metal 9 to retain the film, so the film is tautly stretched to tightly wrap the tray 33.

Figure 4:
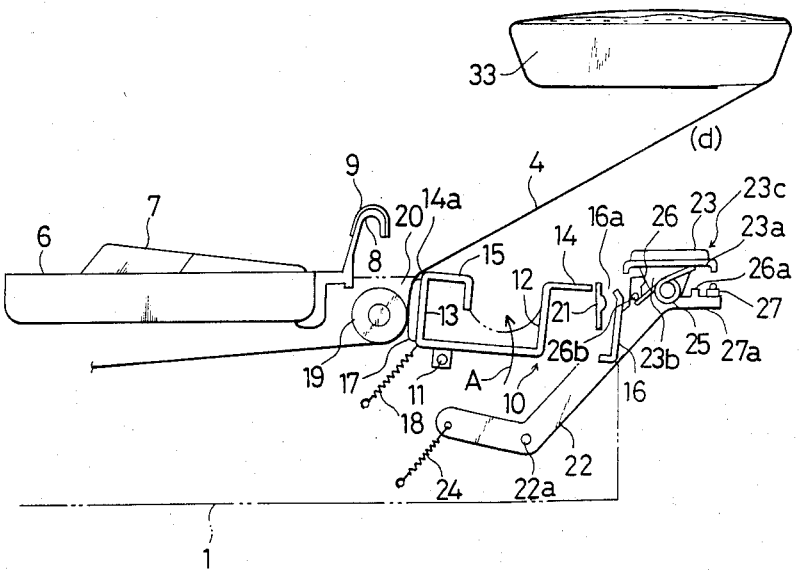

(iv) The tray 33 thus wrapped is moved toward the severing tool 21 to contact the film with the rear end of the snubber 15 at 14*a* to retain the film. This causes the film 4 to tautly stretch so as to have the cross extension 10 pivot about the pin 11 in the direction opposite to arrow A. As a result, the severing tool 21 relatively moves to project through the opening 16*a* above the front snubber 14 as seen at (d) of FIG. 4.

Figure 5:
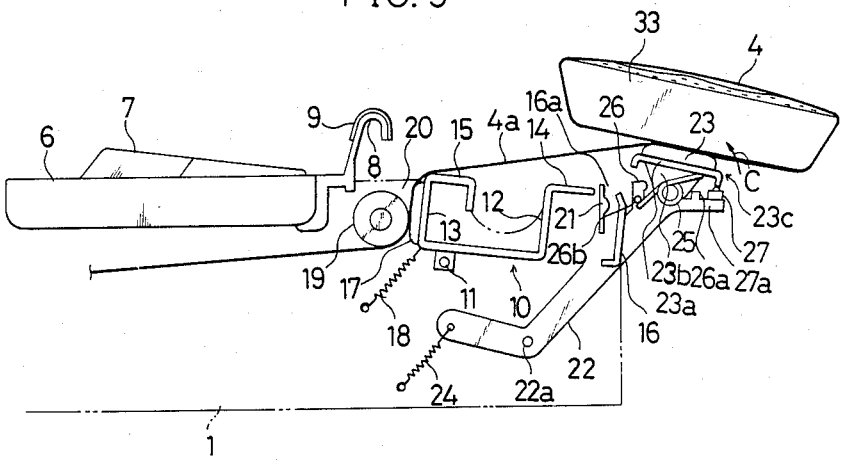

(v) The tray 33 is, as seen in FIG. 5, further moved toward the heat sealer 23*c* to overlap the film at the underside thereof, and to simultaneously place the overlapped portion on the heat panel in respective face contact relationship. As a result, the heat panel 23 pivots in the direction opposite to arrow C to close the detector switch 27, thus supplying the impulse current to the heater to make the panel 23 hot. The panel 23 thus made hot functions to thermally weld the overlapped portion of the film, at the same time, allowing the tray 23 to be tightly wrapped.

Figure 6:
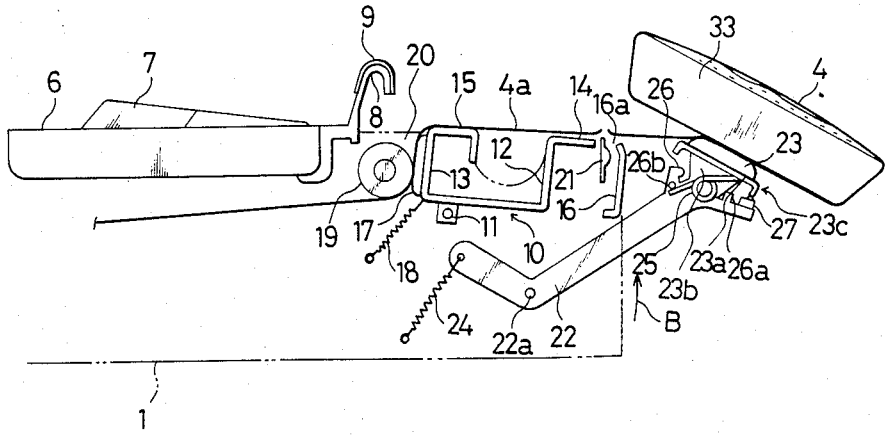

(vi) In so doing, the tray 33 is moved downward from the position of (v), and thus causes the rocker arm 22 to pivot in the direction opposite to arrow B against the force of the spring 24 as seen in FIG. 6. With the pivotal movement of the arm 22, the film moves to sweep past the thermal cutter 21 to cut it at the opening 16*a*.

Figure 7:
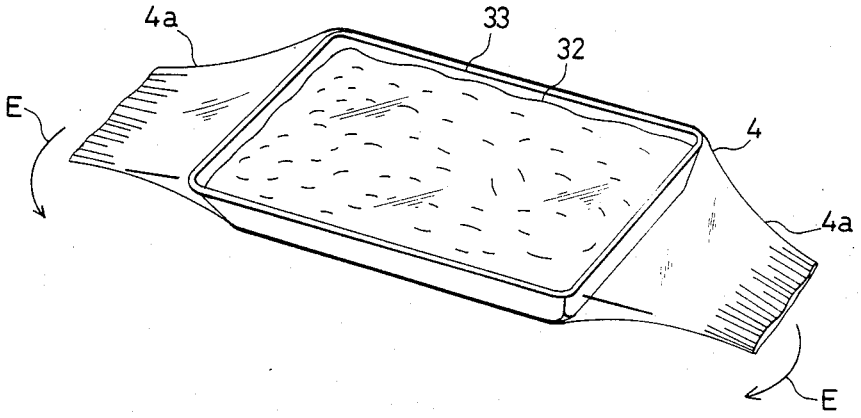
FIG. 7 is a perspective view of product-laden tray.

The tray 33 thus wrapped in the film is better seen in FIG. 7, the lateral wings 4*a*, 4*a* of which are turned in the direction of arrow E to be underfolded. The underfolded wings may be welded for positive sealing in a manner similar to that when the overlapped film is done. It is, however, not always necessary to weld the underfolded wings 4*a*, 4*a* since the film has a tendency to adhere itself. So, the wings may be welded on the case-by-case basis.

As evident from the foregoing description of preferred embodiment, the present invention has advantages over the conventional counterparts. Namely, in response to the action of placing the product means on the heat panel, the rocker arm pivots toward the severing tool. Therefore, the film severing action sequentially follows the welding action, thus ensuring a simple and smooth wrapping operation with minimum labor especially in those instances where a number of the product means are successively wrapped.

It is appreciated that instead of a heat panel which is made hot in response to the action closing a detector switch, the panel may be of a preheat type which is energized in response to the actuation of the power supply button 29. Further, the severing tool may be vertically movably mounted to elevate it at the time of severing the film.

While the form of the invention now preferred has been disclosed as required by statute, other forms may be used, all coming within the scope of the claimed subject matter which follows.

What is claimed is:

1. A hand wrapping apparatus packages comprising a frame;

a pair of transverse rollers carried by the frame and rotatively supporting a roll of film thereon, film from the roll being adapted to be wrapped around the package;

a lid plate supported by the frame forwardly of the rollers, the lid plate having a product rest supported thereon;

a cross extension pivotally mounted on the frame forwardly of the lid plate, a film withdrawal slot being defined between the lid plate and the cross extension to permit film from the roll to be pulled therethrough, the cross extension comprising foward and rearward film snubbers, the cross extension being pivotal relative to the frame between an initial position that is substantially horizontal and a wrapping position that is slated from the horizontal, one of the said snubbers being provided with an elongated opening therein, the cross extension comprising means to normally bias the cross extension to the said initial position;

a severing tool means transversely secured in the frame adjacent to the cross extension to sever the film, the severing tool means being protected by a film snubber when the cross extension is in its initial position, the severing tool means being exposed through the elongated opening when the cross extension is pivoted to the wrapping position;

a rocker arm pivotally mounted upon the frame, the rocker arm comprising a free end that is rotatively movable about the frame from an initial position to a wrapping position, the rocker arm comprising spring means to normally bias the free end toward the initial position, the wrapped package pivoting the free end to the wrapping position by overcoming the bias of the spring means; and heat panel means secured to the free end of the rocker arm to receive the package and to thermally weld the film when contacted by the film wrapped package, portions of the film simultaneously contacting the heat panel means and the severing tool means when the rocker arm free end is pivoted to the said wrapping position;

whereby the film about the wrapped package will simultaneously be thermally welded by the heat panel means and other portions of the film will be simultaneously cut by the severing tool means.

2. The hand wrapping apparatus of claim 1 and pivotal mounting means between the heat panel means and the free end of the rocker arm to permit pivotal movement of the heat panel means relative to the rocker arm between an initial position and a heat sealing position.

3. The hand wrapping apparatus of claim 2 and a detector switch carried by the free end of the rocker arm, the switch being open when the heat panel means is in its said initial position, the switch being contacted by a portion of the heat panel means when the heat panel means is pivoted to the heat sealing position, the switch being closed upon contact to allow electrical current to flow to the heat panel means.

4. The method of hand wrapping a package having a top and bottom with a film comprising the steps of partially wrapping the package by applying a portion of the film over part of the package bottom and over the package top;

stretching the film by moving the partially wrapped package and contacting a pivotally mounted snubber with an unwrapped portion of the film;

pivoting the snubber by use of the film and exposing a film severing means;

moving the partially wrapped package and completely surrounding the package with the film, the surrounding including overlapping portions of the film;

placing the package with the overlapped portions directly upon a heat panel;

pivotally moving the heat panel with the package thereon and contacting the film severing means with a unwrapped portion of the film; and simultaneously severing the film with the film severing means and thermally welding the overlapped film portions with the heat panel.

5. The method of claim 4 wherein the pivotally moving comprises contacting an electrical switch with the heat panel and causing electrical current to flow to the heat panel.

* * * * *